US005348307A

United States Patent [19]

Duggan

[11] Patent Number: 5,348,307

[45] Date of Patent: Sep. 20, 1994

[54] PADDLE GAME APPARATUS

[76] Inventor: Matthew S. Duggan, 2061 Lewisville-Clemmons Rd., Apt. 109-1, Lewisville, N.C. 27012

[21] Appl. No.: 134,639

[22] Filed: Oct. 12, 1993

[51] Int. Cl.[5] ..... A63B 67/10

[52] U.S. Cl. ..... 273/320; 273/329; 273/330; 273/414

[58] Field of Search ..... 273/319, 320, 321, 329, 273/330, 331, 334, 335, 413, 414

[56] References Cited

U.S. PATENT DOCUMENTS

| | | | |
|---|---|---|---|
| 1,017,376 | 2/1912 | Brandt | 273/320 |
| 1,184,822 | 5/1916 | Caplette | 273/328 |
| 1,189,921 | 1/1916 | Cory | 273/328 |
| 1,559,953 | 11/1925 | Furman | 273/321 |
| 1,671,749 | 5/1928 | Spaulding | 273/328 |
| 2,042,984 | 6/1936 | Fritz | 273/67 |
| 2,147,157 | 2/1939 | Goertz | 273/330 |
| 2,194,761 | 3/1940 | Maihack | 273/328 |
| 2,196,253 | 4/1940 | Di Bella | 273/320 |
| 2,480,264 | 8/1949 | Regenold | 273/328 |
| 3,078,099 | 2/1963 | Hyman | 273/328 |
| 4,368,890 | 1/1983 | Horstmann | 273/328 |

*Primary Examiner*—William H. Grieb
*Attorney, Agent, or Firm*—Charles Y. Lackey

[57] ABSTRACT

A paddle ball game and method of ball control associated therewith which includes two paddles held parallel to each other and a resilient ball supported between them. Each player observes the ball's location through the transparent material used to form the paddle's ball engagement area and moves the paddle to roll the ball into the aperture in the other player's paddle. The paddles also feature a handle mounted offset from the surface of the paddle and a flexible net which covers the aperture to catch the ball after it passes through. Alternatively, an inelastic cord is also used to tether the ball to the paddle. In another embodiment, means are provided to illuminate the engagement area for play in the dark.

13 Claims, 4 Drawing Sheets

PADDLE GAME APPARATUS

BACKGROUND OF THE INVENTION

1. Field of the Invention

This invention relates generally to games, and specifically to new and useful improvements in games which use two paddles and a ball.

2. Description of the Prior Art

Heretofore, paddle and ball games consisted mainly of striking a ball with a portion of the paddle, propelling it into the air or against a wall, and then catching the ball in a device (such as a net) mounted on the paddle. When the ball is in flight, the player has no control over it. It is subject to gravity, the wind, and the player's luck or skill. The ability to continuously control the ball's path is not possible with the prior paddle games.

Existing games are played mainly individually, or in groups with each player trying to excel during his or her turn. Because the competitions are just a series of trials, the level of challenge and enjoyment is limited. The skill of one player can not be directly matched to the skill of another, which would allow each player to take advantage of the strengths and weaknesses of the opponent. Also, in existing prior art games, a player does not usually have the opportunity to out-think, out-maneuver, or be quicker than the opponent, as in a true contest of skill. The present invention enables direct competition between two players.

In prior art games, paddles are usually specifically constructed for swinging at and striking a target ball. The handle most often is mounted in the same plane as the paddle and adjacent to the ball engagement area. This allows more leverage when the paddle is swung which helps when hitting the ball, but poor control if such an arrangement were used with the present invention. Control of the ball is minimized since the player has to move the handle a farther distance with it mounted on the periphery to move the ball between the paddles, especially when rotating the paddle about the center of the ball engagement area. Moreover, pressing the ball between these paddles causes more force to be transmitted to the hand holding the paddle to keep it in contact with the ball during play. Both of these contribute to player fatigue and lessen the enjoyment of the game. More stresses are placed mechanically on the paddle itself when the handle is placed on the perimeter of the ball engagement area, thus causing it to flex more during play.

The paddles in prior art games are normally constructed of a solid opaque material. This is to give strength to the paddle. If these paddles were used in the present invention, they would have limited appeal because the opaque nature of the material would not allow the players to see the ball during play or each other without looking over or around the edges of the paddle. The present invention solves this problem by providing paddles from a transparent material, which allows the players to see each other and the ball.

SUMMARY AND OBJECTIVES OF THE INVENTION

This invention presents a new paddle ball game concept where the paddle is specifically designed to roll the ball along its surface rather than to strike it. This concept allows a way to continuously control the motion of the ball. Thus, the direction of the ball can be monitored and controlled by the players, rather than just having to wait and see where it goes. The paddles are first positioned with a ball held between them with a small amount of pressure. Then each player moves their paddle to roll the bah into the aperture in the opponent's paddle. The paddles are made of a transparent material to be able to observe the ball's location and the action of the opponent.

An object of this invention is to provide an amusement game which allows a player to compete directly with another player using a paddle and ball apparatus. The motion of the ball between the paddles is a direct result of the input from each player and thus increases the unpredictability and enjoyment factor of the game and makes play constantly changing. The players can use both offensive and defensive moves. One player will try to move the ball in one direction, but the other player will see the ball heading in that direction and will move the paddle to counteract.

Another object is to present a game which is played by pressing a ball between two parallel paddles which are held by different players and during play are moved to cause the ball to roll into an aperture in the opponent's paddle.

An object of the present invention is to provide a game where the motion of the paddle surfaces controls the ball during play. The action of one surface tries to roll the ball in one direction while the action of the other surface tries to roll the ball in a different direction, with the resulting motion of the ball being a combination of the effect of each surface.

Yet another object is to provide a paddle made of a transparent material, such as clear or lightly colored plastic which allows the players to see each other, the paddles, and the ball during play. Being able to see through the paddle during play increases the functionality and enjoyment of the game.

Another object of the present invention is to provide an embodiment having means for illuminating the paddle's playing surface to allow the game to be played in the dark.

Another object is to provide a handle mounted on the back of the paddle close to the center, so that control of the paddle is optimized in that the paddle can be rotated about the center and moved in other directions with a minimum of hand motion.

An advantage of this invention is that it can be played on many skill levels. The skill level is dependant on the ability of the player and the opponent. So, expert players can enjoy the games as much as novice players.

Another object is to provide a game device which can be enjoyed by people all ages, whose rules are simple, and which promotes the development of skill, quickness, and strategy.

The present invention consists of certain novel features of construction, combination, and arrangement of parts as will be hereinafter described in detail and particularly set forth in the appended claims, reference being had to the accompanying drawings which form a material part of this application wherein like characters of reference designate like parts throughout the several views.

DESCRIPTION OF THE PREFERRED EMBODIMENT

Figure 1:
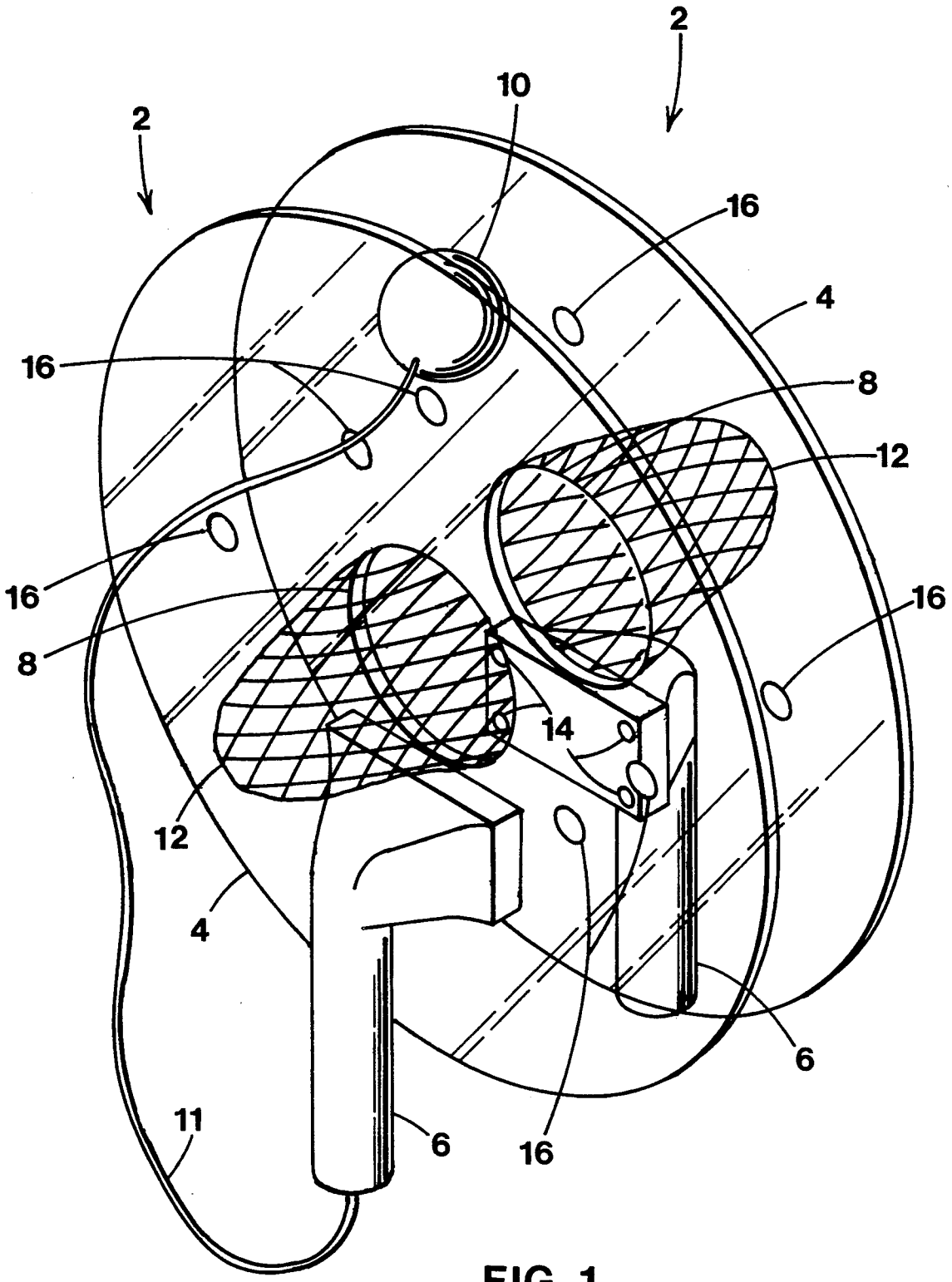
FIG. 1 is an isometric view of the game apparatus comprising the present invention consisting of two paddles with a ball positioned between them.
Figure 2:
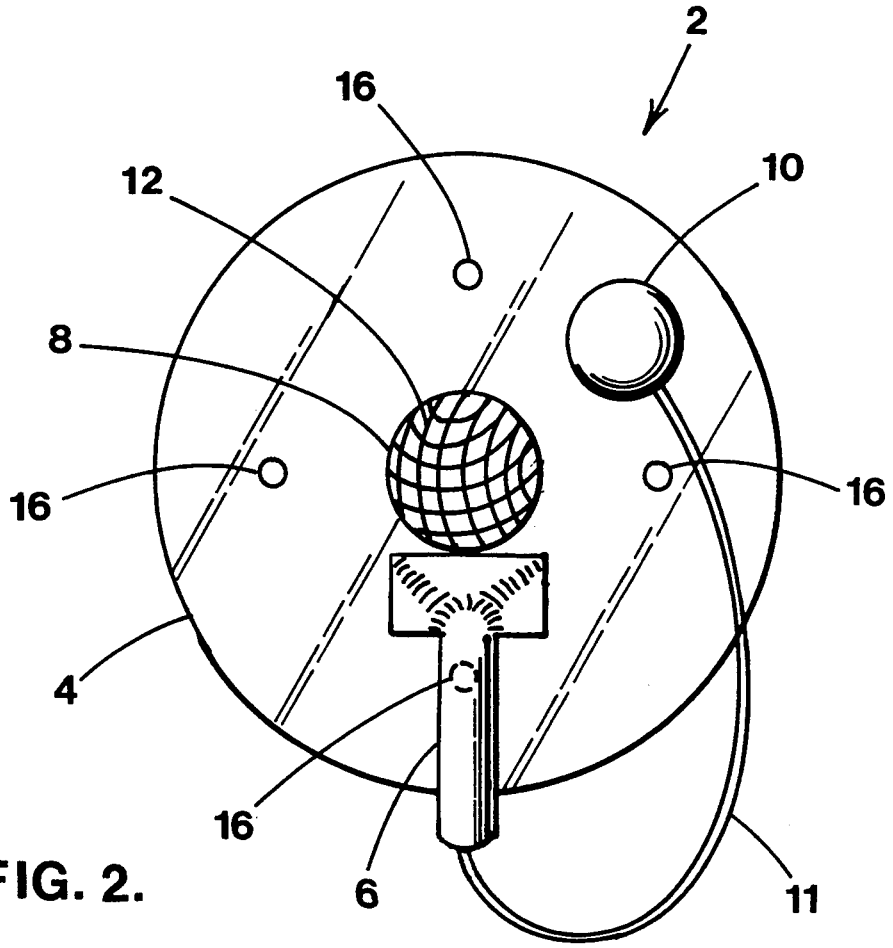
FIG. 2 is a front elevational view of a paddle.
Figure 3:
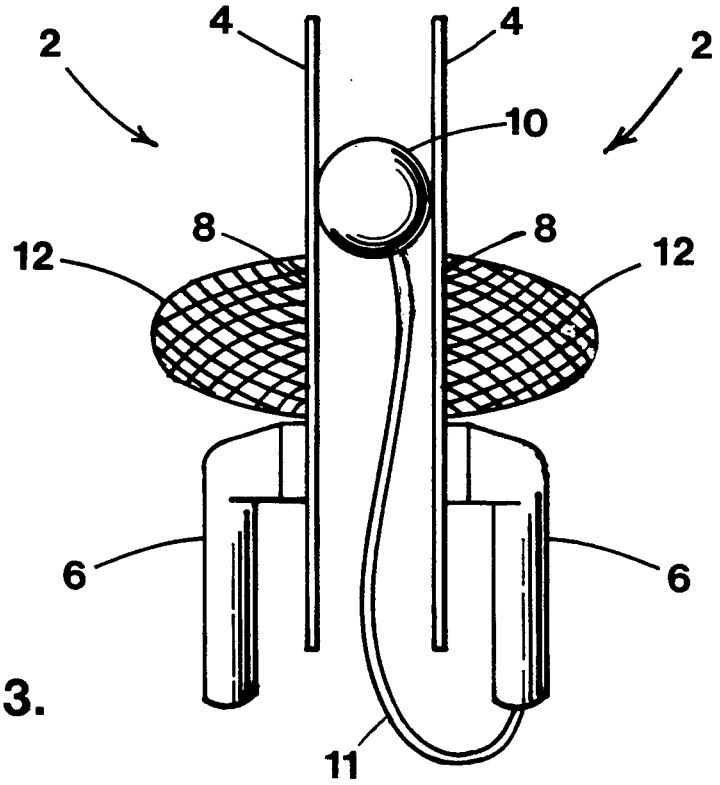
FIG. 3 is a side elevational view of two paddles in playing position.

Referring now to FIGS. 1, 2, and 3, two paddles 2 are shown in playing position (parallel to each other), and a ball 10 is supported between them by pressing the paddle surfaces together with a small amount of force.

The ball 10 comes in contact during play with the ball engagement area 4 of the paddle 2. The ball engagement area 4 is constructed from a relatively thin material and circularly shaped. The shape could also be oval or some other suitable configuration, however an oval or circular shape allows the most playing area for rolling the ball 10 on the surface of the paddle.

In the preferred embodiment, the ball engagement area 4 is made from a transparent plastic material. Both clear and lightly colored tints are available which allow the players to see each other and provide an attractive design. The transparency feature allows the players to see the ball 10, and the opponent's paddle 2. Using this visual information the players determine which way to move their paddles 2 in order to get the ball 10 into the aperture 8 in the opponent's paddle 2. The transparent paddle 2 also lets the players see each other's reactions directly which increases enjoyment of the game. Other opaque materials like wood or metal can be used to construct the ball engagement area 4 and create a playable paddle, but the advantages of the transparent feature will be missing. The players will have to look around the edges of the paddles 2 to see each other and the location of the ball 10.

In the interior of the ball engagement area 4 is an aperture 8 which is slightly larger than the ball 10 in diameter. Around the lip of the aperture 8 is mounted a flexible net 12 to catch the ball 10 after it passes through. The retention of the ball 10 provides a way to verify that it actually passed through the aperture 8. The net 12 can be constructed from a variety of suitable materials such as woven hemp, nylon, or plastic, and attached by various methods. A collar can be glued or ultrasonically welded to hold the opening of the net 12 against the back of the ball engagement area 4.

The ball 10 is mounted to one paddle 2 by an inelastic tether 11. The tether 11 keeps the players from searching for the ball 10 if it inadvertently falls from between the paddles 2. They can retrieve it by a pull on the tether 11. The tether 11 also can verify that the ball 10 passed through the aperture 8, since the tether 11 would be laced through the aperture 8. If the net 12 is not implemented, then verification that the ball 10 went through the aperture 8 can be made using the tether 11.

The L-shaped handle 6 is mounted to the ball engagement area 4 and extends down parallel to the paddle surface but is offset enough to allow room for the player's fingers to wrap around the handle grip easily. By designing the handle 6 in this fashion, it can be attached closer to the center of ball engagement area 4. Being close to the center rather than positioned at the periphery of the ball engagement area 4, affords a player the ability to move the paddle 2 with less hand motion especially when the paddle 2 is rotated about the center of the ball engagement area 4.

The handle 6 is formed of plastic using injection molding. The shape of the handle 6 can be either straight or contoured to match a player's hand. The handle 6 can also be constructed from other materials such as wood or metal. The figures show the handle 6 attached with the use of four screws 14. Other suitable techniques can be used to attach the handle 6 such as ultrasonic welding. One end of the tether 11 is anchored to one of the handles 6.

The ball 10 is a spherical object made from a resilient material which has specific properties. The ball 10 needs to roll, and not slip during play, consequently the surface of the ball 10 needs to provide this capability. The ball 10 should be made from a springy material to absorb the pressure exerted by the paddles and yet not reduce its ability to roll along the surface of the ball engagement area 4. Suitable rubber and plastic materials are available for this purpose.

In the preferred embodiment, the paddle 2 is sized for ease of motion and for inside or outside play. A paddle diameter of 12 inches works well with a ball diameter of 2 inches, however these sizes are given as examples only and should not be construed as limiting since the ball and paddle can be proportioned larger or smaller and still yield a playable game.

Figure 4:
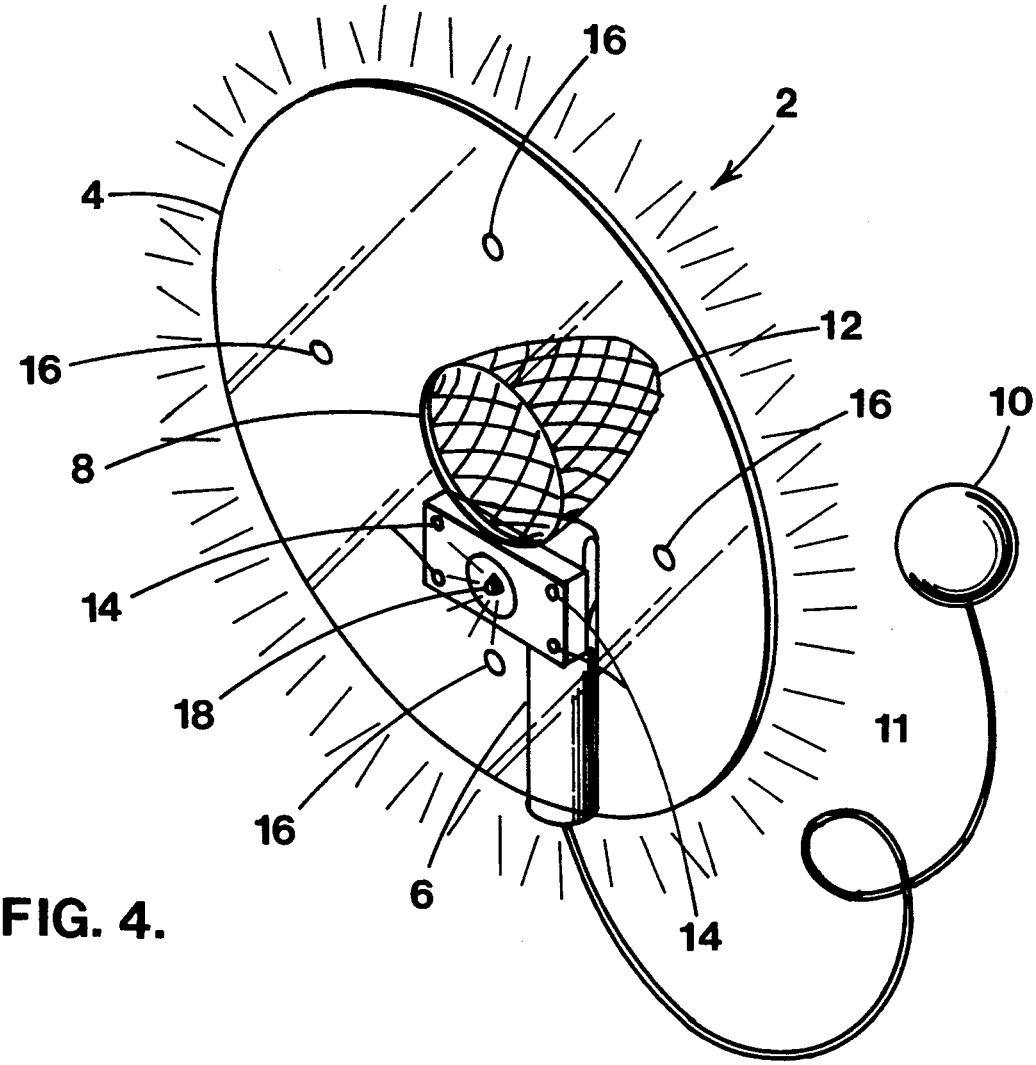
FIG. 4 illustrates a paddle equipped with illuminating means for play in the dark.
Figure 5:
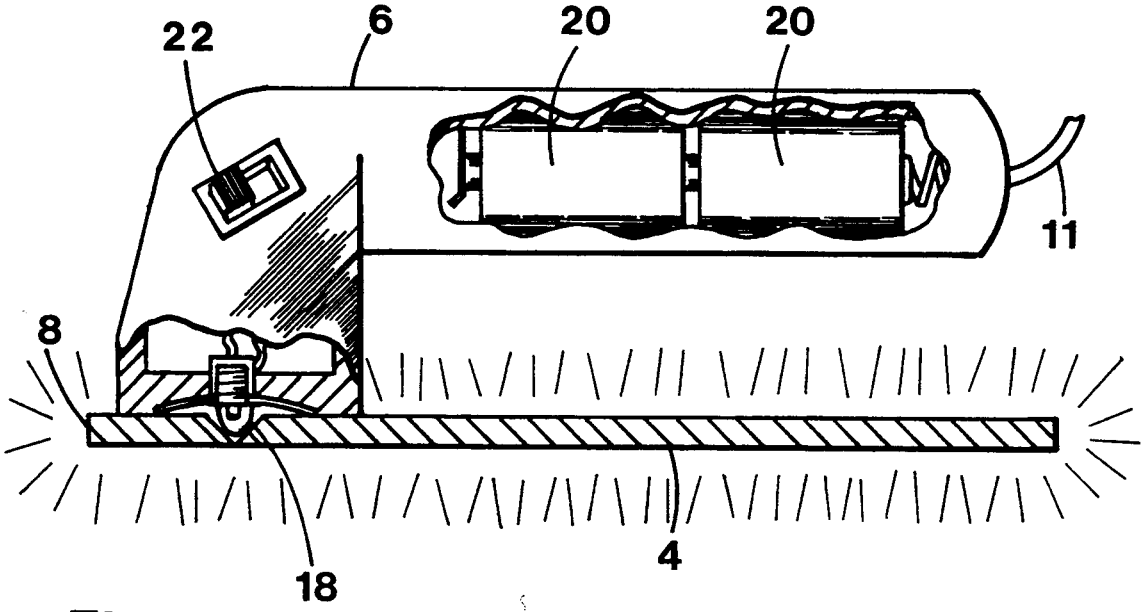
FIG. 5 is a partial sectional view of the handle shown in FIG. 4.

In another embodiment of the invention shown in FIG. 4, the transparent paddle material is illuminated by means of a small light source. When light is applied to the middle of the transparent material, the surfaces and edges emit the light and present a glowing appearance. This effect is most noticeable in a darkened room, and yields enough light that the game could be played in the dark. The small light bulb 18 is mounted in the base of the handle 6 (see FIG. 5) and protrudes slightly into a recessed portion of the ball engagement area 4. The handle 6 also houses the power supply, with two batteries 20 being shown. The light feature is controlled by the player through an on/off switch 22 mounted on the side of the handle 6.

During play with the present invention, a player scores one point by being the first to pass the ball 10 through the aperture 8 in the opponent's paddle 2. A variety of games can be played, with one consisting of the first player to earn 11 points being the winner.

Figure 6:
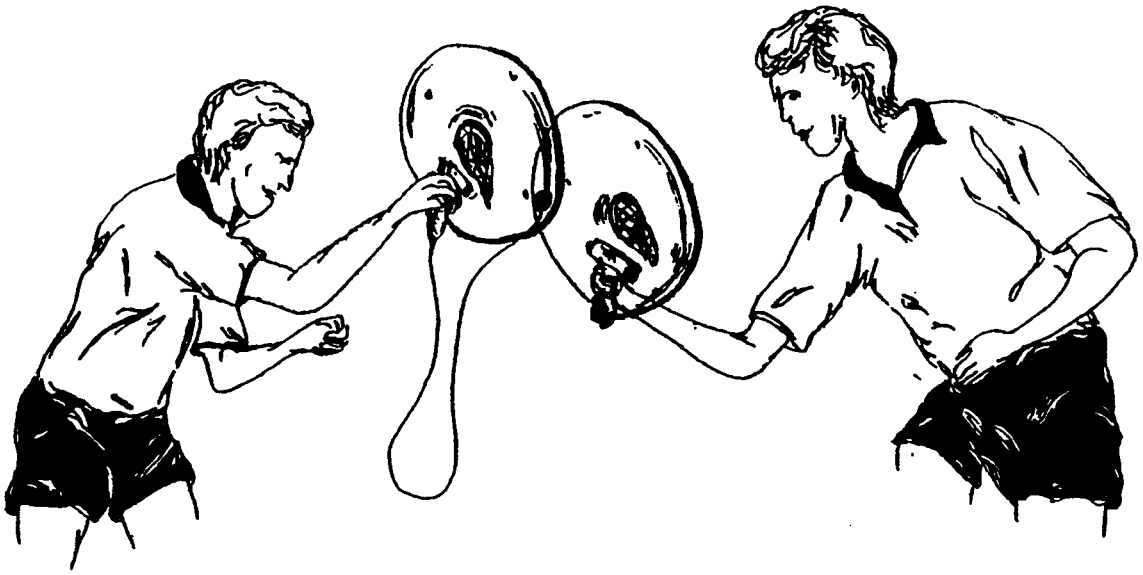
FIG. 6 shows two people playing the game.

As shown in FIG. 6, the players stand face-to-face approximately arms length apart, each with a paddle 2 in hand. The paddles 2 are held vertical and parallel to each other as shown in FIG. 3. Between the paddles 2 is held the ball 10 which is kept there-between by the players exerting just enough pressure to keep the ball 10 from falling due to gravity. Marked on the playing surface of the ball engagement area 4 are a plurality of starting positions 16, with four being shown. The ball 10 is placed at one of the starting positions 16 to begin play.

The players try to move the paddles 2 to cause the ball 10 to roll into an aperture 8 in the center of the opponent's paddle 2. The players can move the paddles 2 up and down, or left and right, or rotate the paddles 2 about an imaginary axis perpendicular to the ball engagement area 4. The only requirement is that the paddles 2 must remain parallel to each other and maintain enough pressure to keep the ball 10 from falling.

During normal play, one player moves the paddle 2 in one direction, while the other player moves the paddle 2 in a second direction, which results in the movement of the ball 10 in a third direction. Neither player can predict where the ball 10 will go with absolute certainty, though the path of the ball 10 will more closely travel the path of the faster paddle 2. Thus, the player that moves the paddle 2 quicker, or is able to react faster, has an advantage because of better control. Nevertheless, the direction of the ball 10 is not totally predictable, and some of the excitement and enjoyment of the game is that even novice players will score on more experienced players.

A unique feature of the present invention is that both offensive and defensive maneuvers can be developed. As a player moves the paddle 2 and causes the ball 10 to travel in a particular direction, the opponent will react to this tactic and initiate a countermove. This constant feedback of the ball location and motion of the opponent's paddle 2, makes the game exciting and results primarily from the paddles being transparent.

After the ball 10 goes through the aperture 8 it will fall into a flexible net 12. To begin the next play, the ball 10 is taken from the net by the player that was just scored upon and placed at any of the starting positions 16 to begin the next play. If during play, the ball 10 falls from between the paddles 2, then play is halted and no points are scored. Play is continued after placing the ball 10 at one of the starting positions 16.

This description shall not be construed as limiting the ways in which this invention may be practiced but shall be inclusive of many other variations that do not depart from the broad interest and intent of the invention.

What is claimed is:

1. In a paddle ball game, a method of controlling the motion of a ball by the movement of two paddles with apertures therein comprising the steps of: positioning a resilient ball between the surfaces of two parallel paddles; maintaining the ball in position with slight pressure from each paddle surface; moving each surface in an attempt to roll the ball through an aperture on the opposite surface; and securing the ball when it is passed through an aperture to determine the score.

2. The method is claimed in claim 1 wherein the paddle surfaces are illuminated so that the game can be played in the dark.

3. A multiple player non-striking paddle ball game comprising: two paddles each having a ball roll- engaging area, a ball passing aperture, and a handle mounted on the back of the ball engagement area behind the ball passing aperture; a resilient ball rollably movable between and continuous with a ball engagement area of the paddle; and ball securing means associated with the ball passing aperture whereby the paddles are moved by the players while held in a substantially vertical position to urge competitively the ball to roll through an aperture.

4. The game is claimed in claim 3 wherein the paddles are formed from transparent material.

5. The game is claimed in claim 3 wherein the ball securing means is a flexible net mounted over the aperture for retaining the ball after it passes through the aperture.

6. The game is claimed in claim 3 wherein the ball securing means is an inelastic tether having a first end connected to one of the paddles and a second ball-securing end.

7. The game is claimed in claim 3 wherein the paddle is illuminated by a light source mounted in the ball engagement area.

8. The game is claimed in claim 4 wherein the ball securing means is a flexible net mounted over the aperture for retaining the ball after it passes through the aperture.

9. The game is claimed in claim 4 wherein the ball securing means is an inelastic tether having a first end connected to one of the paddles and a second ball-securing end.

10. The game is claimed in claim 4 wherein the paddle is illuminated by a light source mounted in the ball engagement area.

11. The game is claimed in claim 5 wherein the ball securing means is an inelastic tether having a first end connected to one of the paddies and a second ball-securing end.

12. The game is claimed in claim 5 wherein the paddle is illuminated by a light source mounted in the ball engagement area.

13. The game is claimed in claim 6 wherein the paddle is illuminated by a light source mounted in the ball engagement area.

* * * * *